US006320172B1

(12) United States Patent
Watkins

(10) Patent No.: US 6,320,172 B1
(45) Date of Patent: Nov. 20, 2001

(54) MICROWAVABLE CONTAINER FOR FOOD PRODUCTS AND METHOD OF FABRICATING SAME

(76) Inventor: Jeffrey T. Watkins, 11240 Loch Lomond Dr., Laurinburg, NC (US) 28352

( * ) Notice: Subject to any disclaimer, the term of this patent is extended or adjusted under 35 U.S.C. 154(b) by 0 days.

(21) Appl. No.: 09/523,493

(22) Filed: Mar. 10, 2000

Related U.S. Application Data

(60) Provisional application No. 60/124,243, filed on Mar. 12, 1999.

(51) Int. Cl.[7] ..... H05B 6/80

(52) U.S. Cl. ..... 219/725; 219/727; 219/730; 219/732; 229/43

(58) Field of Search ..... 219/725, 727, 219/728, 730, 731, 732; 229/43, 48; 426/107, 113, 234, 243; 99/DIG. 14

(56) References Cited

U.S. PATENT DOCUMENTS

| | | | |
|---|---|---|---|
| 3,066,844 | 12/1962 | Moore | 229/48 |
| 4,036,423 | 7/1977 | Gordon | 229/43 |
| 4,210,674 | 7/1980 | Mitchell | 426/107 |
| 4,448,309 | 5/1984 | Roccaforte et al. | 206/525 |
| 4,678,882 | 7/1987 | Bohrer et al. | 219/10.55 E |
| 4,734,288 | 3/1988 | Engstrom et al. | 426/107 |
| 5,008,024 | 4/1991 | Watkins | 219/10.55 E |
| 5,097,107 | 3/1992 | Watkins et al. | 219/10.55 E |
| 5,214,257 | 5/1993 | Riskey | 219/10.55 E |

FOREIGN PATENT DOCUMENTS

| | | |
|---|---|---|
| 0320294A2 | 12/1988 | (EP) . |
| 0451530A2 | 3/1991 | (EP) . |
| 1 399 151 A | 4/1965 | (FR) . |
| WO 91/15096 | 10/1991 | (WO) . |
| WO 96/36546 | 11/1996 | (WO) . |

*Primary Examiner*—Tu Ba Hoang
(74) *Attorney, Agent, or Firm*—Needle & Rosenberg P.C.

(57) ABSTRACT

A container for microwave heating of a food product, and a method of fabricating such a container, wherein the container includes a tub assembly having a moisture-impervious floor and one or more sidewalls. A quantity of food product, such as popcorn, is placed in a pocket formed in a sheet of barrier material, and a continuous heat seal is formed between the floor of the tub and the sheet of barrier material. A microwave susceptor can be disposed to the floor for heating the food product.

78 Claims, 5 Drawing Sheets

MICROWAVABLE CONTAINER FOR FOOD PRODUCTS AND METHOD OF FABRICATING SAME

CROSS-REFERENCE TO RELATED APPLICATION

This application claims priority to U.S. Provisional Application Ser. No. 60/124,243, which was filed on Mar. 12, 1999.

BACKGROUND OF THE INVENTION

1. Field of the Invention

The present invention relates generally to microwavable containers for food products, and methods of fabrication thereof. The present invention relates more specifically to a microwavable tub for storing, shipping, heating and serving food products such as, for example, popcorn, puffed cheese snacks and pork rinds.

2. Description of Related Art

The increasing popularity of microwave cooking has lead to the development of several types of containers for microwave heating of food products. For example, a number of bag-type containers for microwave popping of popcorn are available. These containers are typically formed of paper or other flexible materials, and often include heating elements of microwave interactive susceptor material that absorb microwave energy to generate heat, which pops the popcorn. Such containers are typically shipped and stored in a folded configuration and, upon heating and popping of the corn, unfold into an expanded configuration.

More rigid containers have also been developed, such as cup-shaped containers for microwave heating of popcorn. These containers typically are in the form of generally frustoconical paperboard tubs. A microwave susceptor is installed on or around the floor of the tub, and a quantity of unpopped corn and cooking oil or shortening is placed in the tub's interior. A plastic film or other barrier material is often applied over the corn in an effort to seal out external contaminants, seal in moisture, and preserve freshness. It has been found, for example, that moisture loss from popcorn inhibits popping and reduces popped volume. Efforts to form a hermetic seal around the food product in previously known containers have proven less than fully satisfactory. For example, one previously known container provides a concave cooking tray formed of coated paperboard stock for containing the food product and heating through microwave absorption. The tray includes a number of folds or corrugations, which present discontinuities in any seal attempted to be formed with a barrier material. These discontinuities form air channels that allow moisture loss from the food product. In an attempt to overcome this problem, a moisture impervious liner has been provided around the exterior of the tray, which liner is sealed to the barrier film around the lip of the tray. The multiple components required in previously known containers, however, typically results in increased costs of materials and assembly. Another disadvantage found to inhere in previously known containers incorporating a tray for containing the food product is the potential for the food product to be displaced inadvertently from the tray onto the shelf or ledge formed by the lip of the tray, removing the food product from thermal contact with the microwave susceptor material, often resulting in incomplete cooking or popping.

Previously known paperboard tub containers for microwave cooking are typically assembled by depositing the food product onto the floor of an upright container, or into a heating tray placed within the container, and then installing liners and/or film in various configurations in an attempt to form a seal around the food product. As discussed above, the provision of cooking trays and liners undesirably increases expense and may adversely affect cooking performance. If the food product is distributed across the container floor, attempts to form a seal around the food product by sealing a cover film to the container walls typically are unsuccessful, as moisture may escape through the walls and floor of the container, and/or through the seam between the walls and floor.

Thus it can be seen that a need exists for a container for microwave cooking of food products, which overcomes disadvantages of previously known containers. A need further exists for an economical and efficient method of fabricating a microwavable container for food. It is to the provision of a container and method of fabrication meeting these and other needs that the present invention is primarily directed.

SUMMARY OF THE INVENTION

The microwavable container and method of assembly of the present invention provide a number of improvements over previously known containers and methods of assembling such containers. For example, the container of the present invention prevents moisture loss and contamination by means of a simplified hermetic sealing arrangement described in greater detail below. This sealing arrangement results in a fresher food product, thereby enhancing consumer enjoyment. Shelf life of the product is also extended. The simplified sealing arrangement reduces material and assembly costs, resulting in a more commercially viable product. The container is easy and convenient for consumers to use, has an attractive shelf appearance, is nestable for ease of shipping and handling and reduced shelf space requirements, and provides large visible surface areas for the display of point-of-sale marketing features.

Briefly described, one aspect of the present invention provides a container for microwave heating of a food product. The container preferably includes a substantially upright sidewall assembly defining an interior volume, the sidewall assembly having a base, a mouth and at least one wall panel extending between the base and the mouth. The container preferably also includes a moisture-impervious floor extending from the at least one wall panel adjacent the base. The floor has an interior face defining the lower extent of the interior volume and an exterior face opposite the interior face. The container preferably also includes a sheet of barrier material forming a pocket for containing a food product, the sheet of barrier material being continuously sealed to the interior face of the floor around the pocket.

In preferred embodiments, the container of the present invention includes a generally rectangular tub assembly having four wall panels. Alternatively, the tub assembly can be a generally cylindrical or frustoconical tub having one wall panel closed upon itself. The tub assembly of the present invention can be fabricated from paperboard blanks folded and assembled in manners described in greater detail below. The floor of the container comprises a moisture barrier, preferably provided on the interior face of the floor to prevent migration of moisture into or through the floor material. The floor preferably, but not necessarily, also comprises a microwave susceptor material to enhance heating of the food product. The microwave susceptor material is preferably disposed to the interior face of the floor, but can be disposed to its exterior face or be formed integrally with the floor. The microwave susceptor and the moisture barrier can be one and the same through appropriate material selection, or can be separate materials or layers functioning in combination. The at least one wall panel preferably slopes outwardly from the base to the mouth, whereby multiple containers can be nestably stacked.

In another aspect, the present invention provides a container for microwave heating of a food product, the container preferably including a generally polygonal tub having three or more generally flat wall panels, a moisture-impervious floor and an open mouth. In a further preferred embodiment, the tub is generally rectangular, having four wall panels. The container preferably also includes a sheet of barrier material, such as a moisture-impervious balloon film, forming a pocket for containing a food product, the sheet of barrier material being continuously sealed to the floor around the pocket. Support legs preferably extend below the floor from corners defined by the intersections of adjacent wall panels, the support legs being separated by notches formed by removal of portions of the wall panels. A microwave susceptor is preferably disposed to the floor, and may be disposed to the interior or exterior face of the floor, or be integrally formed with the floor. The wall panels preferably slope outwardly from the support legs to the mouth of the tub, whereby multiple containers can be nestably stacked.

In yet another aspect, the present invention provides one or more cooperating paperboard blanks for forming a container for microwave heating of a food product. In a preferred embodiment, a sidewall blank is provided having three or more wall panels, and more preferably four wall panels, adjacent wall panels joined along score lines for folding to form a sidewall assembly. A floor blank is also provided, having edges adapted to be attached to a respective wall panel of the sidewall blank. The floor blank preferably is formed from a moisture-impervious material and optionally includes a microwave susceptor.

In another aspect, the present invention provides a container for microwave heating of a food product, the container including a tub having at least one wall panel and a floor providing a moisture barrier. The container further includes a sheet of barrier material deformed to comprise a pocket for containing a food product, the sheet of barrier material sealed to said floor about the periphery of the pocket. The floor of the container preferably also includes a microwave susceptor to enhance heating performance.

In another aspect, the present invention provides a container for microwave heating of a food product, the container including a sidewall assembly having a base, a mouth, and at least one wall panel extending between the base and the mouth. The container further includes a floor extending horizontally from the at least one wall panel adjacent the base, the floor having an interior face and an exterior face and the at least one wall panel having an interior face and an exterior face as well. The container also includes a sheet barrier material, which cooperates with the interior face of the at least one wall panel and the interior face of the floor to form a volume for containing the food product. The sheet of barrier material is sealed to the interior face of the at least one wall panel.

In still another aspect, the present invention provides a method of assembling a container for microwave heating of a food product. The method preferably includes forming a pocket in a sheet of barrier material, depositing a quantity of a food product within the pocket, placing a tub assembly having a floor and at least one wall panel over the food product, and sealing the barrier material to the floor of the tub assembly around the pocket to encapsulate the quantity of food product between the barrier material and the moisture-impervious floor of the tub assembly. In a further preferred embodiment, the barrier material is a moisture-impervious film, and the sealing step of the method is preferably carried out by heat sealing the sheet of moisture-impervious film to the floor of the tub assembly. Preferably, the heat seal is formed by applying heat from the outside of the container, through the paperboard or other material of construction of the tub assembly. The forming step can be carried out by deforming the barrier material as with a mandrel and die, vacuum forming, heat forming, folding, crimping, and/or through the provision of a preformed pocket. Heat can be applied to the sheet of barrier material during the forming step, as through the use of a heated vacuum platen, to plastically deform the material. The method may further include attaching the barrier material to a wall panel of the tub assembly at one or more locations.

In another aspect, the present invention provides a method of assembling a container for microwave heating of a food product, the method entailing fabricating a tub assembly by folding at least one blank to form a floor and at least one wall panel, forming a pocket in a sheet of barrier material, depositing a quantity of a food product within the pocket, inserting at least a portion of the barrier material within the tub assembly whereby the pocket of food product is adjacent the floor of the tub assembly, and forming a continuous seal between the barrier material and the floor of the tub assembly around the pocket.

In another aspect, the present invention provides a method of hermetically sealing a food product within a microwave cooking container, the method entailing depositing the food product between a sheet of barrier material and a moisture barrier portion of the container, and forming a continuous seal between the barrier material and the moisture barrier portion of the container.

These and other features and advantages of preferred forms of the present invention are described herein with reference to the drawing figures.

DETAILED DESCRIPTION

Figure 1:
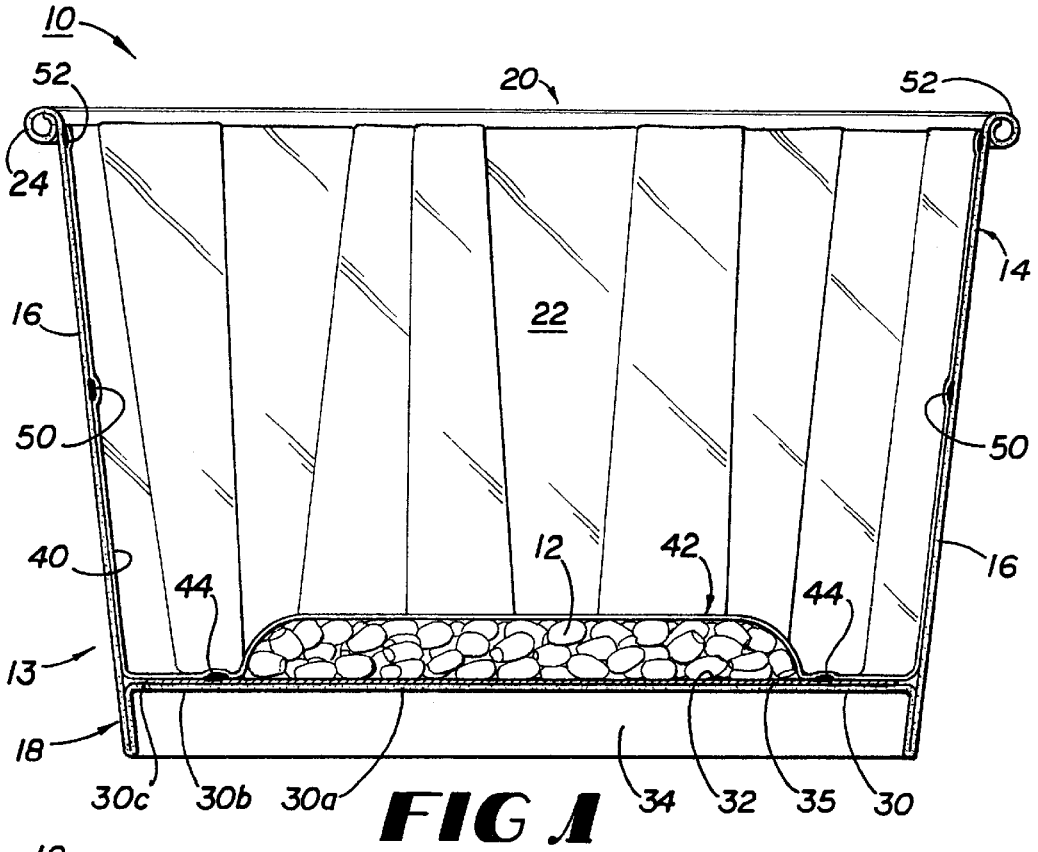
FIG. 1 shows a cross-sectional elevation of a container according to one embodiment of the present invention.

Referring now to the drawing figures, wherein like reference numerals represent like parts throughout unless specifically indicated otherwise, preferred forms of the present invention will now be described. With reference first to FIG. 1, the present invention is related to a container 10 for microwave heating, as with a standard microwave oven, of a food product 12. The food product 12 may be, for example, popcorn, pork rinds, puffed cheese snacks, or other food product. The container of the present invention is particularly well-suited for, but is not limited to, the heating of food products that expand or puff when cooked. In alternative embodiments, the container of the present invention can be used to heat beverages, such as coffee or tea. Cooking oil, shortening, spices, preservatives, flavorings, stabilizers, colorants, or other substances may be included with the food product 12. Moreover, one or more surfaces of the container 10 can be printed, labeled or otherwise provided with text, graphics or other features for marketing, informational or source indicating purposes.

The container 10 preferably includes a tub assembly 13 having a substantially upright sidewall assembly 14, formed of paperboard, paper, cardboard, plastic, or other foldable, moldable or deformable material. Acceptable results may be obtained, for example, using 15, 18 or 24 point SBS (solid bleached sulfate) paperboard. The material(s) of construction used to form the sidewall assembly 14 are selected to result in a container 10 that is substantially rigid (i.e., capable of supporting the weight of the container 10 and its contents in normal use by a consumer without undue deflection), and to provide economy and ease of fabrication. One or both of the interior and exterior faces of the sidewall assembly can comprise a coating, laminate, coextrusion or other treatment, such as for example polyethylene or other polymer(s), flourocarbon treatment or wax, to provide a barrier against staining or absorption of oils, water or other liquids from the food product 12. As a representative example, a flourocarbon treatment sold under the tradename FC807 by the 3M Company can be applied to the sidewall assembly.

The sidewall assembly 14 includes at least one wall panel 16. A single, curved wall panel 16 can be formed into a generally cylindrical or frustoconical container 10, or multiple flat wall panels can be formed into a multi-walled, polygonal container 10 as will be described more particularly with reference to FIGS. 2–5. For example, in the embodiment shown in FIG. 2 and described in more detail below, the sidewall assembly 14 includes wall panels 16*a*–16*d*. The sidewall assembly 14 preferably further includes a base portion 18 at the lower edge of the wall panel(s) 16, which is adapted to rest on a support surface such as the floor of a microwave oven (not shown), and maintain the container 10 in a stable, upright position. The upper extent of the sidewall assembly 14 preferably comprises an open mouth 20 providing access to the interior volume 22 bounded by the sidewall assembly 14. The upper edge(s) of the wall panel(s) 16 may be rolled, folded, or otherwise formed to provide a lip 24, to enhance the structural integrity of the container 10, and/or to assist in handling the container 10.

Figure 2:
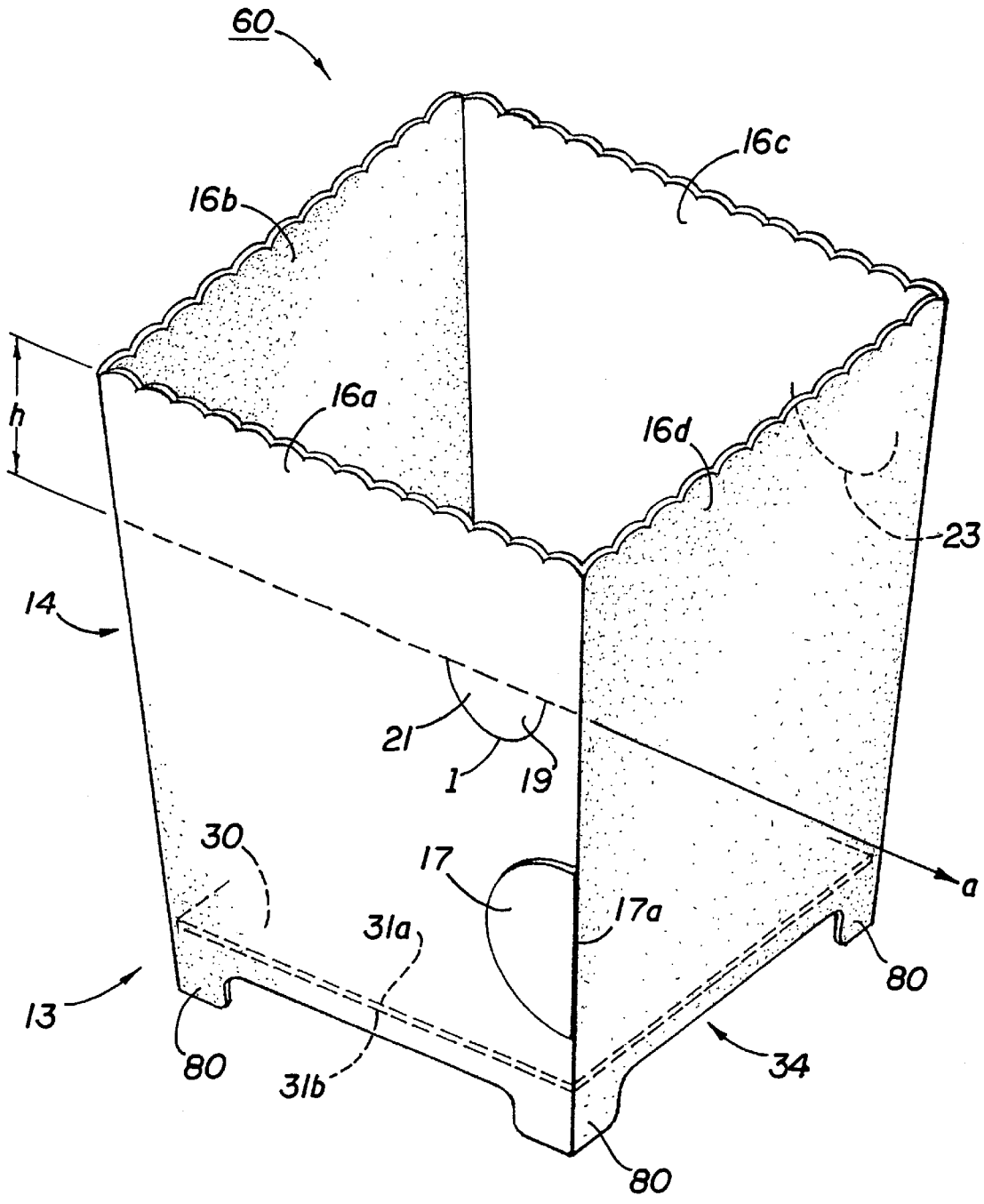
FIG. 2 shows a perspective view of a container according to yet another embodiment of the present invention.
Figure 3A:
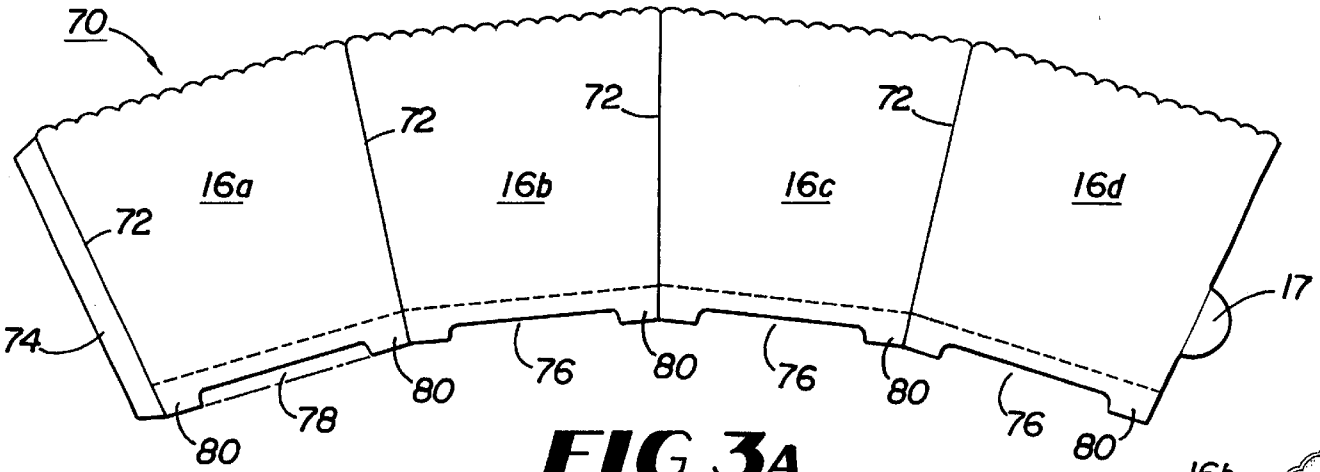
FIGS. 3*a* and 3*b* show top plan views of blanks used to fabricate the container of FIG. 2, according to one form of the invention.
Figure 3B:
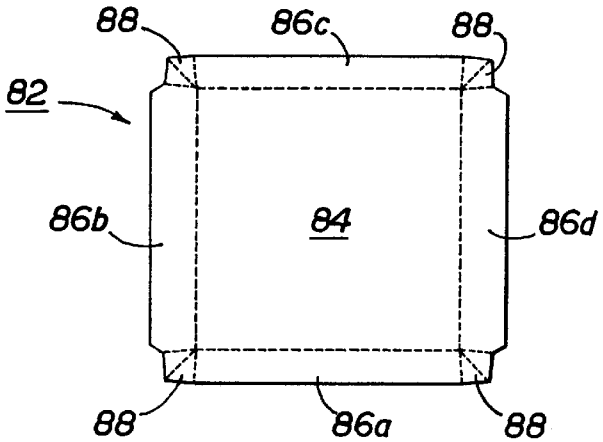

One or more handles, projections or other surface features may be provided to assist in handling the container 10. For example, at least one optional handle 17, as best shown in FIG. 2, is especially helpful after the heating of food products and the container 10 may be hot. Optional handle 17 is a flap extending away from the wall panel 16*d* and can be folded along an upwardly extending axis that is substantially non-horizontal, such as edge 17*a*, so as to position the handle 17 against an adjacent wall panel, such as wall panel 16*a* in the embodiment shown in FIG. 2. This foldable characteristic of handle 17 allows handle 17 to move between an inoperative position where handle 17 is co-planar with the wall panel 16*a* and an operative position where handle 17 extends away from the wall panel 16*a* and therefore not to significantly affect the stacking of one container 10 into another one. Preferably, handle 17 is an integral part of the wall panel 16*d* in one embodiment as shown in FIG. 3*a*. Alternatively, handle 17 can be a separate element and attached or fixed to the wall panel 16*d* at a location of the user's choice. For instance, handle 17 can be a separate piece of paperboard, paper, cardboard, plastic, or other foldable, moldable or deformable material having a sticky end that can be stuck to the wall panel 16 prior to use by the consumer. In this manner, the stackability of the container 10 is preserved. Note that although the handle 17 is associated with the wall panel 16*d* in the embodiments shown in FIGS. 2 and 3*a*, obviously, handle 17 can be associated with any of the wall panels 16*a*–16*d*. Additionally, the substantially upright or vertical axis about which handle 17 pivots can be located on any of the wall panels 16*a*–16*d* at any desired location thereon. Also, more than one handle can be utilized to further facilitate handling of the container 10.

Additionally, at least one projection 19 can be formed to facilitate stacking two or more containers 10 together. For the embodiment shown in FIG. 2, projection 19 is formed by cutting the wall panel 16*a* along the solid line l and then pushing flap portion 21 outwardly away from the wall panel 16*a* so that the flap portion 21 pivots upwardly along axis a to assume its operative position. In the inoperative position of projection 19, the projection 19 is co-planar with the wall panel 16*a* and the bottom of the projection 19 merges with the wall panel 16*a* seamlessly and, in the embodiment shown in FIG. 2, the projection 19 is part of the wall panel 16*a*. The formed projection 19 can be considered as a "stacking ear" projecting from the wall panel 16*a* and movable along the substantially horizontal axis a. The projection 19 is located at a distance h from the upper edge of the wall panel 16*a*. The distance h is variable to accommodate variable uses of the container 10. The container 10 can have more than one stacking ear, as for instance in the embodiment shown in FIG. 2, and more clearly shown in FIG. 2*a*, wherein the container 10 also has a projection 23 or stacking ear formed on the wall panel 16*c*, opposite the projection 19 with projection 23 being similarly dimensioned to projection 19. Although it is not necessary, it is preferable that if container 10 has two or more projections, they arc formed on opposing wall panels. It is also preferable that the projections be similarly shaped, each extending the distance h from the upper edge of the wall panel 16*a* and pivoting about a respective axis a. By providing the wall panel(s) 16 with a slight outward slope from the base 18 to the mouth 20, two or more containers 10 as described herein may be nestably stacked, one within another. If the container 10 is of a type having at least one projection 19, the combination of the outward slope of the wall panel(s) 16 and the projection(s) 19 in the operative position facilitates the stacking of multiple containers in a nested array. The nested array of containers 10 can be packaged as a unit, as by applying a shrink-wrapped sleeve or other overwrap.

Figure 2A:
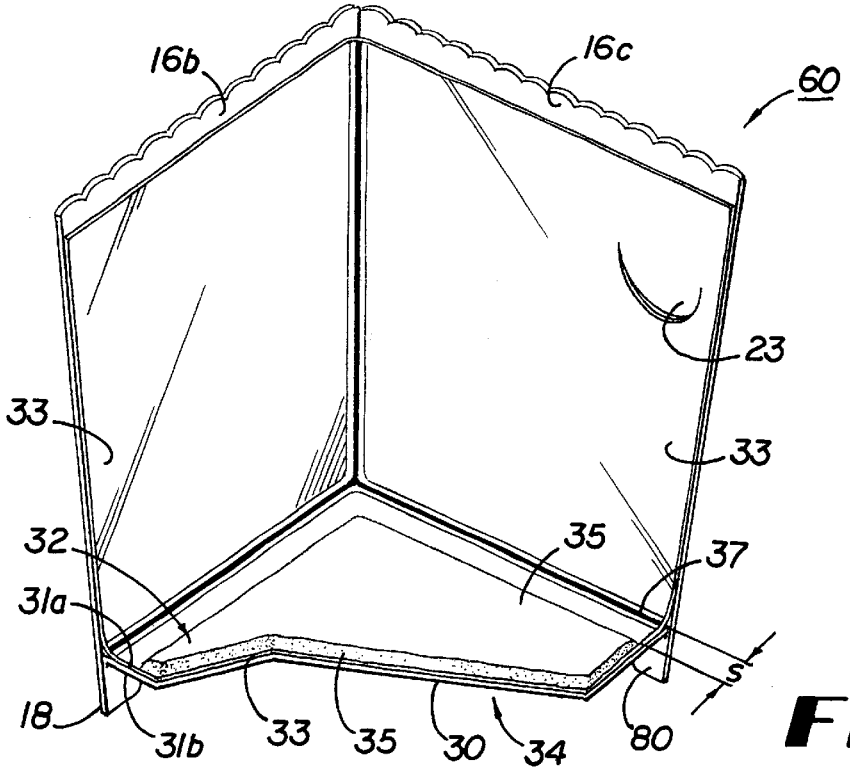
FIG. 2*a* shows a partially cut-away, exploded view of the container of the present invention shown in FIG. 2.

Referring to FIG. 2*a*, the tub assembly 13 preferably further includes a floor portion 30 extending generally horizontally from the wall panel(s) 16. The floor portion 30 has an interior face 31*a* defining the lower boundary of the interior volume 22 of the container 10, and an exterior face 31*b* opposite the interior face 31*a*. The floor 30 comprises a moisture-impervious material to prevent moisture loss from food product 12 encapsulated thereby, as will be described below. The floor 30 is preferably formed from a moisture barrier material or is provided with a moisture barrier coating or layer along substantially its entire interior face. Acceptable results have been obtained, for example, using 20 or 24 point SBS paperboard with a 2 mil polyester laminated on its interior face. Alternatively, acceptable results can be obtained by using 12.5–13 point SBS paperboard laminated on its interior face with 8 lb./ream nylon. Other polymer coatings, laminates, coextrusions or layerings, such as for example: polypropylene; polyvinyl dichloride (PVDC)-coated nylon; PVDC-coated polyester; and/or polyester and polypropylene composites, may be used to provide substrate materials such as paperboard, cardboard, paper or plastics with acceptable barrier properties.

Figure 2B:
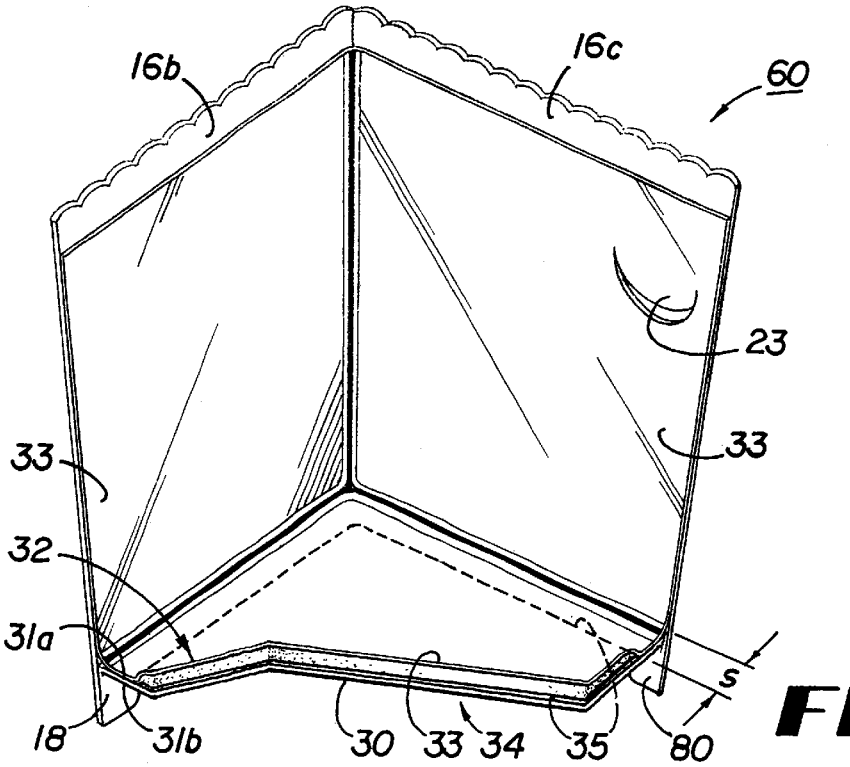
FIG. 2*b* partially shows a partially cut-away, exploded view of the container according to one embodiment of the present invention shown in FIG. 1.

The floor 30 can be integrally formed with the wall panel(s) 16, or can be a separate component attached to the wall panel(s) by adhesive, folding, crimping, or other standard attachment means. A microwave susceptor 32, such as a 48-gauge or 2 mil metallized polyester film, vacuum deposited metal, carbon or metallic based coatings, laminates, inks or print, other microwave interactive material(s), or any combination of them, is preferably disposed to the floor 30. The susceptor 32 is preferably laminated or otherwise affixed to the interior face 31*a* of the floor 30. Alternatively, the susceptor 32 can be laminated or otherwise affixed to the exterior face 31*b* or be integral with the floor 30. The susceptor 32 is preferably sized and placed to be underlying at least the portion of the floor 30 upon which food product 12 is initially placed. FIGS. 2*a* and 2*b* show two embodiments of the susceptor 32 of the present invention.

The susceptor 32 includes a film of polyester 33 and a layer of metal 35. A metallic material such as aluminum is deposited onto the polyester film 33 to form a very thin metal layer 35 over the polyester film 33. The deposition process is controlled so that the metal layer 35 substantially occupies, but not necessary fully, the portions of floor 30 underneath the food product 12, as shown in FIG. 2*a*. Alternatively, the deposition process can be controlled so that the metal layer 35 fully occupies the portions of floor 30 underneath the food product 12. Then, portions of the metal layer are removed in areas where the metal layer is not needed. In other words, the distance s between the edge of the metal layer 35 and the line 37 representing the location of the bottom of a wall panel has a nonzero value in the preferred embodiment. Obviously, the distance s can have a zero value as well. The susceptor 32 is disposed to the floor 30 such that the polyester film 33 is in contact with the floor 30 and indeed, covers substantially the entire floor 30, with the metal layer 35 to be in contact with the food product. Preferably, the polyester film 33 covers the whole interior surface 31*a* and extends upwardly along the inner surfaces of the panel 16*a*–16*d* as shown in FIG. 2*a*. The food product is placed over the metal layer 35 and during cooking remains at all times in thermal contact with the susceptor 32. In another embodiment, the susceptor 32 has an additional film of polyester or similar material (not shown) covering the metal layer 35 so that the metal layer 35 is sandwiched in the lamination. In this embodiment, the food product 12 is not in direct contact with the metal layer 35. In a further embodiment as shown in FIGS. 1 and 2*b*, for examples, the susceptor 32 is disposed to the floor 30 such that the metal layer 35 is in contact with the floor 30, with the polyester film 33 to be in contact with the food product 12. Adhesive materials can be applied to the floor 30 prior to the application of the susceptor 32 to bind the metal layer 35 with the floor 30. Although acceptable microwave heating of the food product 12 can be obtained without the inclusion of the microwave susceptor 32, the inclusion of a microwave susceptor has been found to provide faster and more consistent heating.

The floor 30 can be raised a distance above the base 18, forming a lower chamber 34 between the exterior face 31*b* and the support surface such as the floor of a microwave oven. The lower chamber 34 is preferably open to heat and air transfer to and from the container's surroundings, through the provision of one or more notches or openings, as is described in greater detail below. It is believed that placement of the exterior face 31*b* of the floor 30 of the container 10 approximately around 1.905 cm or smaller, but in no case greater than 3 cm, above the floor of a microwave oven or a similar supporting surface optimizes cooking performance, as this distance places the microwave susceptor 32 applied to the interior face 31*a* of the floor 30 approximately one-quarter wavelength of the microwave energy above the oven floor.

Figure 6:
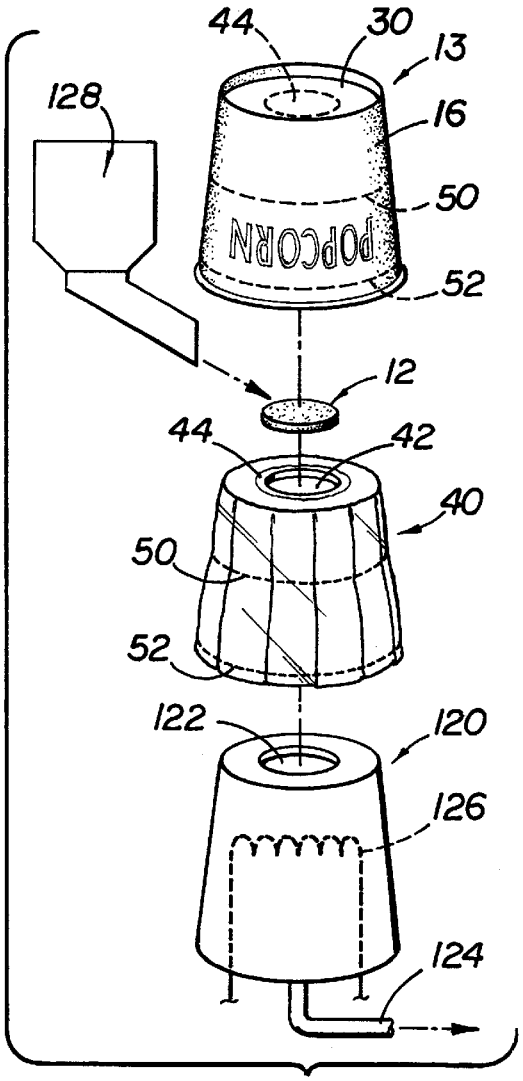
FIG. 6 depicts schematically a method of assembly of a container according to one form of the present invention.

Referring to FIGS. 1 and 6, the container 10 of the present invention preferably 10 further comprises a sheet of barrier material 40 forming a pocket 42 for containing a quantity of the food product 12. The sheet of barrier material 40 can go up along the wall 16 anywhere between the bottom of the wall 16 and the top of the wall 16. Indeed, in one embodiment as shown in FIG. 1, the sheet of barrier material 40 goes up to near the top of the wall 16. In another embodiment (not shown), the sheet of barrier material 40 just covers the floor 30 and does not go up the wall 16 at all. The pocket 42 is preferably generally centered on the floor 30, and does not normally extend to the exterior edges of the floor 30 where it joins with the bottom of wall panel 16. In the embodiments where a microwave susceptor 32 with a sized metal layer 35 is provided, the pocket 42 substantially covers the sized metal layer 35 as shown in FIG. 1. In this manner, the floor 30 comprises a generally central portion 30*a* underlying the pocket 42 containing the food product, and an annular or peripheral outer portion 30*b* not having food product supported thereon. The interior face 30*c* of this annular or peripheral outer portion 30*b* provides a sealing surface for contacting and forming a seal with the barrier material 40.

For a variety of food product applications, the barrier material 40 preferably comprises a moisture-impervious (i.e., resistant to passage of water or water vapor) material such as, for example: a 50-gauge coated heat-sealable polyester film; a barrier-coated nylon film; or other heat-resistant and moisture impervious sheet polymers. A seal 44 is provided between the sheet of barrier material 40 and the moisture-impervious floor 30 around the pocket 42, to hermetically seal the food product 12 within the pocket 42. The seal 44 can be continuous. In this manner, moisture loss from the food product is minimized or eliminated. The seal 44 is preferably formed by heat sealing. Alternatively, adhesives or other sealants can be used to form seal 44. Moreover, the seal 44 surrounding the pocket 42 of food product is preferably heat-releasable, such that the sheet of barrier material 40 will separate from the floor 30 upon heating to rise with expansion of the food product. One or more openings (not shown) can be provided through the sheet of barrier material 40, outside of the pocket 42 beyond the seal 44, to form release vents for allowing steam and expanding air to escape during heating.

Depending on the particular food product to be contained, the barrier material 40 may be impervious to air or other substances in addition to or instead of being moisture-impervious. For example, for containment of pork rinds, which are more susceptible to spoilage from exposure to oxygen than from moisture, the barrier material 40 may comprise an oxygen-impervious material. In alternative embodiments, the sheet of barrier material 40 may comprise a fluid permeable material that forms a barrier to external contamination, and/or that prevents release of materials contained in the pocket 42. For example, a container for preparing and heating coffee or tea may comprise a barrier material 40 of paper filter material forming a pocket containing ground coffee beans or tea leaves.

Containment of the food product 12 within the pocket 42 in the manner of the present invention provides a number of advantages over containers wherein the food product is distributed over the entire floor or disposed within a tray. For example, the floor 30 forms a flat sealing surface, and does not present discontinuities-forming air channels to allow moisture loss from the food product, as may occur with the use of a cooking tray. Because the pocket 42 does not extend to the edges of the floor 30, moisture cannot escape from the food product 12 through the joint between the floor 30 and the wall panel(s) 16, as may occur with containers wherein the food product is distributed over the entire floor. Also, if a food product such as popcorn is packaged with cooking oil or shortening, the food product can be substantially encapsulated within the oil or shortening within the pocket 42, thereby providing an additional barrier against moisture loss from the food product, and increasing the product's shelf life. The present invention also advantageously optimizes material usage and minimizes the number of components necessary to construct the container, thereby providing a more efficient and economical container.

Figure 1A:
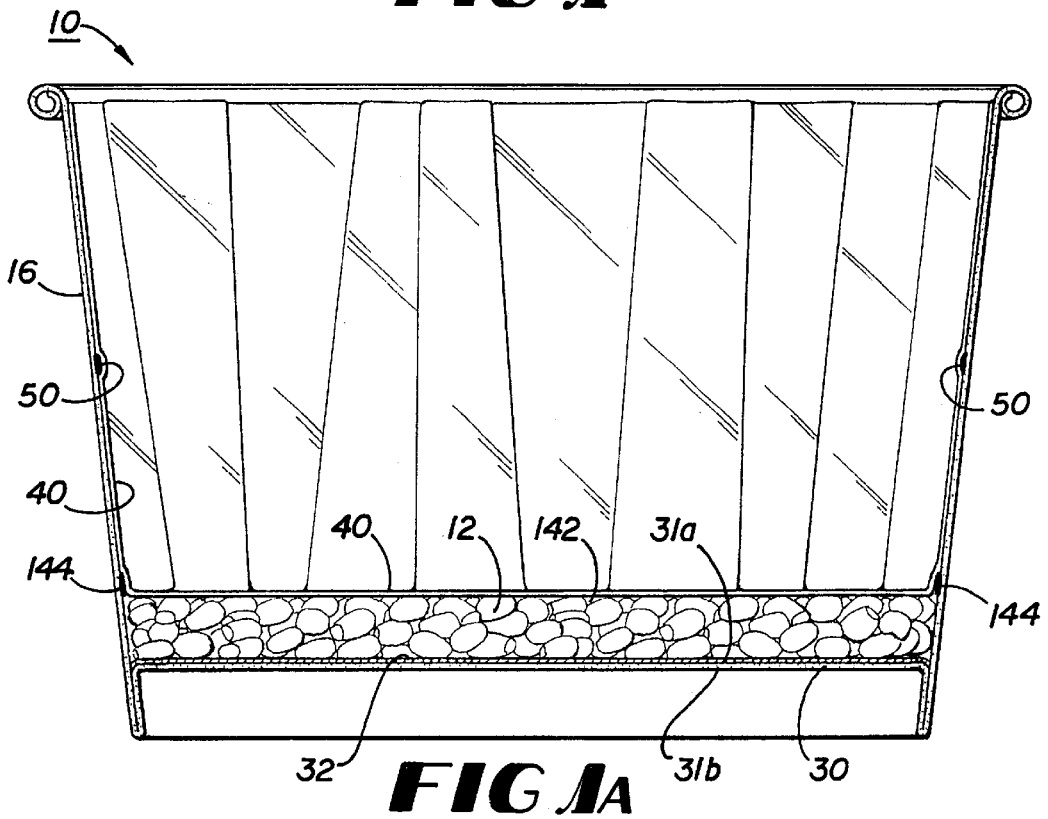
FIG. 1*a* shows a cross-sectional elevation of a container according to another embodiment of the present invention.

It will be appreciated that, however, as shown in FIG. 1*a*, the food product 12 can be contained in a volume 142 defined by the sheet of barrier material 40, the interior face 31*a* of the floor 30 and the wall panel(s) 16. In this embodiment, a seal 144 is provided between the sheet of barrier material 40 and the interior face of the wall panel(s) 16. The seal 144 preferably is a continuous seal formed by heat sealing to hermetically seal the food product 12 within the volume 142.

If the container 10 is of a type having a raised floor 30, the generally central disposition of the pocket 42 of food product 12 on the floor 30 also enhances nestability when a number of containers 10 are stacked, as the pocket 42 of a lower container will nest within the lower chamber 34 of an upper container. Moreover, if the container 10 is of a type having at least one projection or stacking ear 19 as shown in FIGS. 2 and 2*a*, the distance h is chosen such that when a number of containers 10 are stacked, an upper container is supported at a selected position by an adjacent lower container through the engagement of the flap portion 21 of the projection 19 with the upper edge(s) of the panel wall(s) 16 with the bottom of the upper container barely in contact with the pocket 42 of the lower container. This avoids the situation wherein the food product 12 in the pocket 42 of the lower container is severely depressed by the upper container (s), thereby allowing more containers 10 to be stacked together without a concern that the pocket(s) 42 of food product of the lower container(s) will be damaged.

Referring now back to FIG. 1, a first attachment 50 is preferably provided between the sheet of barrier material 40 and the interior surface of the wall panel(s) 16 approximately midway up the height of the wall panel(s) 16. Location of the first attachment 50 approximately midway up the height of the wall panel(s) prevents the sheet of barrier material 40 from rising a substantial distance above the mouth 20 of the container 10 upon inflation with steam or expanding air during heating. A second attachment 52 is preferably also provided between the sheet of barrier material 40 and the wall panel(s) 16 adjacent the mouth 20 of the container 10. The second attachment 52 prevents contamination of the interior, food-contacting surfaces of the container 10 during shipping and storage. The first attachment 50 is preferably continuous about the container 10, and will partially release upon heating to permit steam and expanding air to escape. The second attachment 52 can be discontinuous, in order to allow steam and expanding air to escape, and to facilitate removal of the barrier material 40 by the consumer. The first and second attachments 50 preferably do not fully release upon heating, but are readily released manually by a consumer after cooking of the food product 12. Attachment of the sheet of barrier material 40 to the wall panel(s) 16 also prevents the sheet of barrier material 40 from interfering with the stacking of multiple containers in a nested array. Note that in the embodiment where the sheet of barrier material 40 only covers the floor 30, optional one or more attachments can be provided between the sheet of barrier material 40 and the interior face 30*c* of the peripheral outer portion 30*b* of the floor 30. Attachments can be formed in various kinds of means normally used in the art including glue, or heat sealing, etc.

As seen best with reference to FIGS. 2–5, the tub assembly 13 of the present invention may take the form of a generally polygonal (viewed from the top), hollow tub 60, having three or more wall panels 16*a*–16*d*. In a preferred embodiment, the tub assembly 13 is generally rectangular, having four wall panels 16*a*–16*d*, and a floor 30, the floor 30 indicated by broken lines in FIGS. 2 and 4. The term "generally rectangular" and any similar terms used herein are intended to describe a three-dimensional prismoidal or inverted frusto-pyramidal shape with corners of approximate right angles between adjacent walls. The rectangular tub 60 can take any of a number of particular embodiments, several of which will be described herein by way of example, but not by way of limitation.

In a first example embodiment, described with reference to FIGS. 2, 2*a*, 3*a* and 3*b*, the wall panels 16*a*–16*d* are formed from a unitary paperboard sidewall blank 70, folded along score lines 72. One end of the blank 70 can be provided with a gluing tab 74 for attachment to the opposite end upon folding to form a generally rectangular four-sided sidewall assembly 14. Notches 76 can be formed along the base edge of the wall panels 16*a*–16*d* by removal of a cutout portion 78 of the wall panels 16*a*–16*d*. In this manner, legs 80 are formed at corners of the container defined by the intersection of adjacent wall panels 16*a*–16*d*. The notches 76 allow air circulation to and from the lower chamber 34 during heating, thereby preventing an excess buildup of heat. The size of the cutout portion 78 is variable. It should not be too large to affect the solidarity of the legs 80. Nor should it be too small to affect air circulation to and from the lower chamber 34. The floor 30 can be formed by folding a floor blank 82. The floor blank 82 preferably comprises a generally rectangular floor panel 84, and four edge panels 86*a*–86*d*. The edge panels 86*a*–86*d* are folded to form approximate right angles with the floor panel 84, and are preferably attached to respective wall panels 16*a*–16*d*, as by adhesives or other standard attachment means, to provide a raised floor 30 supported a distance above a supporting surface such as the floor of a microwave oven. Although the corner webs 88 can be removed prior to folding the floor blank 82, it is preferable that they be retained and folded along the score lines indicated in FIG. 3*b*, so that the edge panels 86*a*–86*d* and corner webs 88 form a continuous, leak-proof wall extending substantially upright from the floor panel 84 when the floor 30 is installed and attached into the wall assembly 14. Although it is preferable that the floor 30 be installed with the edge panels folded upwardly, forming a tray-like containment structure, the floor 30 can alternatively be installed and attached into the wall assembly 14 with the edge panels oriented downwardly. As described in greater detail above, the floor 30 comprises a moisture barrier, and preferably further comprises a microwave susceptor, which, in a preferred embodiment, includes a sized metal layer to facilitate microwave heating.

Figure 4:
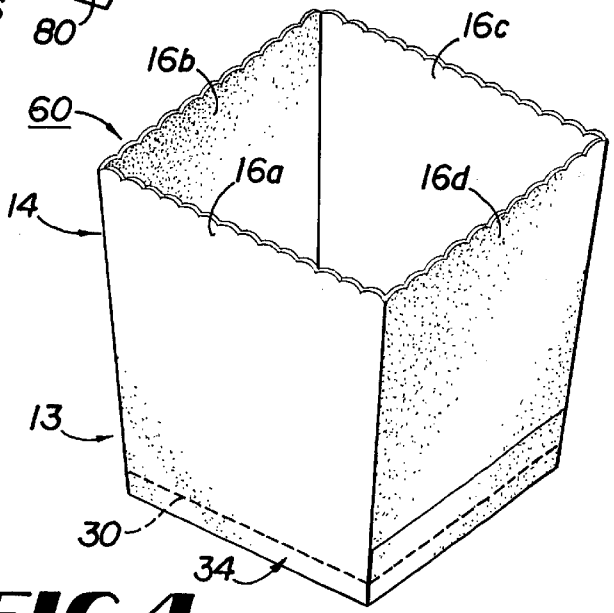
FIG. 4 shows a perspective view of a container according to yet another embodiment of the present invention.
Figure 5A:
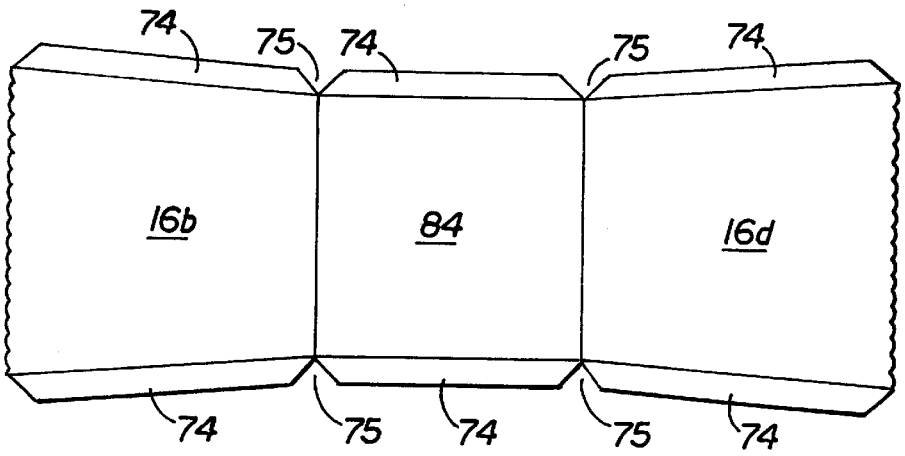
FIGS. 5*a* and 5*b* show top plan views of blanks used to fabricate the container of FIG. 4, according to another form of the invention.
Figure 5B:
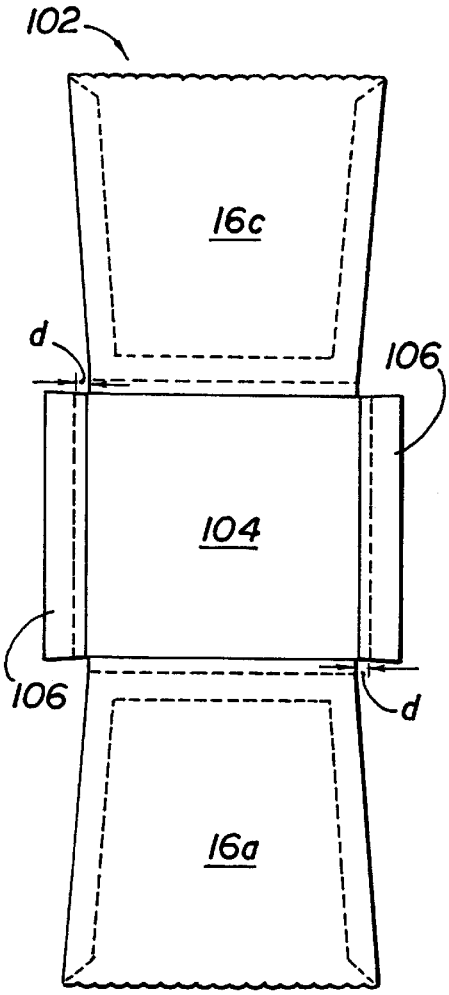

In a second example embodiment, described with reference to FIGS. 4, 5*a* and 5*b*, a generally rectangular tub 60 is formed from a first paperboard blank 100 and a second paperboard blank 102. The first blank 100 comprises second and fourth wall panels 16*b*, 16*d*, and a floor panel 84 therebetween. The second blank 102 comprises first and third wall panels 16*a*, 16*c*, and a substantially continuous base panel 104 extending therebetween. The wall panels 16*a*–16*d* are folded upwardly from the floor and base panels 84, 104 to form a pair of container subassemblies. These subassemblies are arranged in a crosswise configuration, with the floor panel 84 overlying the base panel 104, and the wall panels 16*a*–16*d* forming a four sided sidewall assembly 14. Base extensions 106 of blank 102 are adhesively affixed to the lower portions of wall panels 16*b*, 16*d*, with the floor panel 84 raised a distance d above the base panel 104, thereby forming a lower chamber 34 bounded on its bottom by base panel 104, on its top by floor panel 84, on two sides by base extensions 106, and on two sides by wall panels 16*b*, 16*d*. Openings (not shown) can be provided at the corners formed by the intersections of the wall panels 16*b*, 16*d* and the base extensions 106, to permit air circulation to and from the lower chamber 34. Gluing tabs 74 are preferably provided on wall panels 16*b*, 16*d* and on floor panel 84, and are affixed to wall panels 16*a*, 16*c* to complete assembly of the container 10. V-shaped notches 75 can be removed between the gluing tabs 74; or alternatively, the portion of the blank 100 between gluing tabs 74 can be left intact and folded, as shown in broken lines in FIG. 5*a*, to form a more liquid tight container. As described in greater detail above, the floor panel 84 comprises a moisture barrier, and preferably further comprises a microwave susceptor, which, in a preferred embodiment, includes a sized metal layer to facilitate microwave heating.

Other embodiments may alternatively be devised. For example, multi-walled tub assemblies having three wall panels 16, or five or more wall panels 16, are possible. Additionally, each wall panel 16 may be formed from one or more separate paperboard blanks, and attached to one another to form the sidewall assembly 14 by adhesive, folding and crimping, or other attachment means. Also, although the blanks used to form the tub assembly have generally been referred to a paperboard blanks, other materials of fabrication are possible, such as for example, cardboard and card stock, paper, plastic sheeting, and other foldable, moldable or formable materials.

Method of Assembly

The present invention is further related to a method of assembling a container substantially as described above. The method of assembly will be described according to a preferred embodiment, and with particular reference to FIG. 6.

A sheet of barrier material 40 is provided. A pocket 42 is formed in the sheet of barrier material 40 by folding, crimping, or plastically and/or elastically deforming the sheet of barrier material 40. The pocket is preferably formed by a vacuum platen 120. Alternatively, the pocket 42 can be formed by mechanical folding or deformation. The vacuum platen 120 includes a recess 122 corresponding to the desired shape and size of the pocket 42 to be formed. A vacuum source 124 is in communication with the recess 122 to suction form the pocket 42 in the sheet of barrier material 40. A male plug or mandrel (not shown) can be provided, cooperating with the recess 122 to form the pocket 42. The vacuum platen 120 can further comprise heating means 126 to apply heat to the sheet of barrier material 40 to assist in forming the pocket 42. More preferably, heat can be applied from an external source to assist in forming the pocket 42.

A quantity of food product 12 is deposited in the pocket 42 formed in the sheet of barrier material 40. The food product can be, for example, popcorn, pork rinds, puffed cheese snacks, or other food product. Cooking oil, shortening, spices, preservatives, flavorings, stabilizers, colorants, or other substances may be included with the food product. Metering means 128 are preferably provided for metering a predetermined amount of the food product, as by weight, quantity or volume.

An invented tub assembly 13 is placed over the food product 12. The tub assembly 13 can include, for example, a generally rectangular or cylindrical tub assembly having a floor 30 and at least one wall panel 16. The floor 30 of the tub assembly 13 has a moisture barrier, and preferably also comprises a microwave susceptor, which, in a preferred embodiment, includes a sized metal layer to facilitate microwave heating. The tub assembly 13 can be fabricated by folding at least one blank, as described above by way of particular examples, to form a floor and at least one wall panel. The tub assembly is placed over the food product, which is disposed in the pocket formed in the sheet of barrier material 40, preferably in an upside-down orientation with the mouth 20 of the tub assembly generally downward. Barrier material surrounding the food product is brought into contact with the floor of the tub assembly, with the remainder of the barrier material draping downward along the interior of the walls of the tub assembly.

A seal 44 is formed between the sheet of barrier material 40 and the floor 30 of the tub assembly 13 to encapsulate the quantity of food product 12 between the sheet of barrier material 40 and the floor 30 of the tub assembly. The seal 44 is preferably continuous and formed by heat sealing the sheet of barrier material 40 to the floor of the tub assembly. For example, a heating element can be brought into contact with the exterior face of the floor panel 30 to form the heat seal.

According to the method of the present invention, the food product is hermetically scaled within the container by depositing the food product 12 between the sheet of barrier material 40 and a moisture barrier portion of the container, preferably the floor 30 of the container, and forming a continuous seal between the barrier material and the moisture barrier portion of the container, as described above.

The sheet of barrier material 40 can optionally be attached to one or more wall panel(s) of the tub assembly. For example a first attachment 50 can be made between the sheet of barrier material 40 and the wall panel(s) approximately mid-height along the wall panel(s), and/or a second attachment 52 can be made between the sheet of barrier material 40 and the wall panel(s) adjacent the mouth of the tub assembly.

While the invention has been described in its preferred forms, it will be readily apparent to those of ordinary skill in the art that many additions, modifications and deletions can be made thereto without departing from the spirit and scope of the invention.

What is claimed is:

1. A container for microwave heating of a food product, the container comprising:

(a) a substantially upright sidewall assembly comprising a base, a mouth, and at least one wall panel extending between the base and the mouth;

(b) a floor extending substantially horizontally from the at least one wall panel adjacent the base, the floor having an interior face and an exterior face, the interior face of the floor and the at least one wall panel defining an interior volume; and (c) a sheet of barrier material forming a pocket for containing a food product, the sheet of barrier material having an interior surface and an exterior surface and the interior surface of the sheet of barrier material being sealed to the interior face of the floor around the pocket so that a peripheral outer portion is formed to separate the food product from the at least one wall panel.

2. The container of claim 1, wherein the substantially upright sidewall assembly comprises four wall panels forming a generally rectangular tub.

3. The container of claim 2, wherein the base comprises legs at corners defined by the intersections of adjacent wall panels, the legs separated by notches formed by removal of portions of the wall panels.

4. The container of claim 2, wherein the substantially upright sidewall assembly comprises a unitary paperboard blank folded to form the four wall panels.

5. The container of claim 2, wherein the base comprises a substantially continuous base panel extending between two opposed wall panels.

6. The container of claim 5, formed from a first paperboard blank and a second paperboard blank, wherein the first paperboard blank is folded to form two opposed wall panels and the base panel, and the second paperboard blank is folded to form two opposed wall panels and a floor panel therebetween.

7. The container of claim 1, comprising a generally cylindrical tub having one wall panel closed upon itself.

8. The container of claim 1, wherein the floor comprises a microwave susceptor material.

9. The container of claim 8, wherein the microwave susceptor material comprises a sized metal layer applied to the interior face of the floor.

10. The container of claim 8, wherein the microwave susceptor material a sized metal layer applied to the exterior face of the floor.

11. The container of claim 1, wherein the floor is moisture-impervious.

12. The container of claim 1, wherein the floor comprises a polymer and paperboard laminate.

13. The container of claim 1, wherein the sheet of barrier material comprises a polyester film.

14. The container of claim 1, wherein the pocket is formed in the sheet of barrier material using a vacuum platen.

15. The container of claim 1, wherein the sheet of barrier material is continuously sealed to the interior face of the floor around the pocket by heat sealing.

16. The container of claim 1, wherein the at least one wall panel slopes outwardly from the base to the mouth, whereby multiple containers can be nestably stacked.

17. The container of claim 1, comprising a first attachment between the sidewall assembly and the barrier material.

18. The container of claim 17, wherein the first attachment is approximately mid-height along each the at least one wall panel.

19. The container of claim 18, further comprising a second attachment between the sidewall assembly and the barrier material adjacent the mouth of the container.

20. A container for microwave heating of a food product, the container comprising:

(a) a substantially upright sidewall assembly comprising a base, a mouth, and at least one wall panel extending between the base and the mouth;

(b) a floor extending substantially horizontally from the at least one wall panel adjacent the base, the floor having an interior face and an exterior face, the interior face of the floor and the at least one wall panel defining an interior volume;

(c) a sheet of barrier material forming a pocket for containing a food product, the sheet of barrier material having an interior surface and an exterior surface and the interior surface of the sheet of barrier material being sealed to the interior face of the floor around the pocket; and (d) at least one projection formed on the at least one wall panel, the projection being movable between an inoperative position where the projection is co-planar with the wall panel and an operative position where the projection extends outwardly from the wall panel.

21. The container of claim 20, wherein the at least one projection comprises a flap portion, the flap portion being movable about a substantially non-vertical axis.

22. A container for microwave heating of a food product, the container comprising:

(a) a substantially upright sidewall assembly comprising a base, a mouth, and at least one wall panel extending between the base and the mouth;

(b) a floor extending substantially horizontally from the at least one wall panel adjacent the base, the floor having an interior face and an exterior face, the interior face of the floor and the at least one wall panel defining an interior volume;

(c) a sheet of barrier material forming a pocket for containing a food product, the sheet of barrier material having an interior surface and an exterior surface and the interior surface of the sheet of barrier material being sealed to the interior face of the floor around the pocket; and (d) a handle formed on the at least one wall panel, the handle being movable between an inoperative position where the handle is co-planar with the wall panel and an operative position where the handle extends away from the wall panel.

23. The container of claim 22, wherein the handle is moveable about a substantially non-horizontal axis.

24. A container for microwave heating of a food product, the container comprising:

(a) a generally polygonal tub having at least three substantially flat wall panels interconnected along their side edges, a moisture-impervious floor having an interior face and exterior face, and an open mouth;

(b) a sheet of moisture-impervious barrier material forming a pocket for containing a food product, the sheet of moisture-impervious barrier material being continuously sealed to the floor around the pocket so that a peripheral outer portion is formed to separate the food product from the at least one wall panel; and (c) a microwave susceptor disposed underneath the food product.

25. The container of claim 24, wherein the tub is generally rectangular, comprising four wall panels.

26. The container of claim 25, wherein the wall panels comprise support legs extending below the floor from corners defined by the intersections of adjacent wall panels, the support legs separated by notches formed by removal of cutout portions of the wall panels.

27. The container of claim 26, wherein the four wall panels slope outwardly from the support legs to the mouth of the tub, whereby multiple containers can be nestably stacked.

28. The container of claim 24, wherein the four wall panels are formed by folding a unitary paperboard blank.

29. The container of claim 24, wherein the floor comprises a polymer and paperboard laminate.

30. The container of claim 24, wherein the sheet of moisture-impervious barrier material comprises a polyester film.

31. The container of claim 24, wherein the pocket is formed in the sheet of moisture-impervious barrier material using a vacuum platen.

32. The container of claim 24, wherein the sheet of moisture-impervious barrier material is sealed to the interior face of the floor by heat sealing.

33. The container of claim 24, wherein the microwave susceptor comprises a sized metal layer.

34. The container of claim 24, wherein the tub comprises a movable handle formed on one of the flat wall panels.

35. The container of claim 24, wherein the tub comprises at least one movable projection formed on at least one of the flat wall panels.

36. The container of claim 24, wherein the microwave susceptor is located between the bottom of the food product and the interior face of the floor.

37. The container of claim 24, wherein the microwave susceptor engages the exterior face of the floor.

38. A container for microwave heating of a food product, the container comprising a tub having at least one wall panel and a floor comprising a moisture barrier, the container further comprising a sheet of barrier material deformed to comprise a pocket for containing a food product, the sheet of barrier material continuously sealed to the floor about the periphery of the pocket so that a peripheral outer portion is formed to separate the food product from the at least one wall panel.

39. The container of claim 38, wherein the floor further comprises a microwave susceptor.

40. The container of claim 39, wherein the microwave susceptor comprises a sized metal layer.

41. A method of assembling a container for microwave heating of a food product, the method comprising:

(a) forming a pocket in a sheet of barrier material;

(b) depositing a quantity of a food product within the pocket;

(c) placing a tub assembly having a floor and at least one wall panel, wherein the floor has an interior face and an exterior face, over the food product such that the pocket is substantially closed by the interior face of the floor; and (d) sealing the barrier material to the interior face of the floor of the tub assembly around the pocket to encapsulate the quantity of food product between the barrier material and the interior face of the floor of the tub assembly so that a peripheral outer portion is formed to separate the food product from the at least one wall panel.

42. The method of claim 41, wherein the sealing step comprises heat sealing the barrier material to the floor of the tub assembly.

43. The method of claim 41, wherein the forming step comprises applying vacuum to the sheet of barrier material.

44. The method of claim 41, further comprising attaching the barrier material to a wall panel of the tub assembly.

45. The method of claim 41, wherein the step of attaching the barrier material to a wall panel of the tub assembly comprises forming a first attachment between the barrier material and the wall panel approximately mid-height along the wall panel.

46. The method of claim 45, wherein the step of attaching the barrier material to a wall panel of the tub assembly further comprises forming a second attachment between the barrier material and the wall panel adjacent a mouth of the tub assembly.

47. A method of assembling a container for microwave heating of a food product, the method comprising:

(a) fabricating a tub assembly by folding at least one blank to form a floor and at least one wall panel, wherein the floor has an interior face and an exterior face;

(b) forming a pocket in a sheet of barrier material;

(c) depositing a quantity of a food product within the pocket;

(d) inserting at least a portion of the barrier material within the tub assembly, whereby the pocket of food product is adjacent the interior face of the floor of the tub assembly; and (e) forming a seal between the barrier material and the interior face of the floor of the tub assembly around the pocket so that a peripheral outer portion is formed to separate the food product from the at least one wall panel.

48. The method of claim 47, wherein the step of forming a seal comprises heat sealing the barrier material to the floor of the tub assembly so as to form a continuous seal around the pocket.

49. The method of claim 47, wherein the step of forming a pocket comprises applying vacuum to the sheet of barrier material.

50. The method of claim 47, further comprising attaching the barrier material to a wall panel of the tub assembly.

51. The method of claim 50, wherein the step of attaching the barrier material to a wall panel of the tub assembly comprises forming a first attachment between the barrier material and the wall panel approximately mid-height along the wall panel.

52. The method of claim 51, wherein the step of attaching the barrier material to a wall panel of the tub assembly further comprises forming a second attachment between the barrier material and the wall panel adjacent a mouth of the tub assembly.

53. The method of claim 47, wherein the step of fabricating a tub assembly comprises forming a plurality of wall panels from a unitary sidewall blank.

54. The method of claim 53, wherein the step of fabricating a tub assembly further comprises forming a floor panel and a plurality of upright edge panels from a floor blank, and attaching each upright edge panels to a respective wall panel.

55. The method of claim 47, wherein the step of fabricating a tub assembly comprises forming a generally rectangular tub from first and second container subassemblies, the first subassembly formed from a first paperboard blank to have two wall panels and a floor panel therebetween, and the second subassembly formed from a second paperboard blank to have two wall panels and a base panel therebetween, the subassemblies arranged in a cross-wise configuration with the floor panel overlying the base panel.

56. The method of claim 47, wherein the step of fabricating a tub assembly comprises forming a generally circular container having a curved wall panel and a generally circular floor.

57. A container for microwave heating of a food product, the container comprising:

(a) a substantially upright sidewall assembly comprising a base, a mouth, and at least one wall panel extending between the base and the mouth and having an upper portion proximate to the mouth and a lower portion proximate to the base;

(b) a floor extending substantially horizontally from the at least one wall panel adjacent the base, the floor having an interior face and an exterior face and the at least one wall panel having an interior face and an exterior face; and (c) a sheet of barrier material being sealed to the interior face of the at least one wall panel at the lower portion proximate to the base to form a volume with the interior face of the at least one wall panel and the interior face of the floor for containing the food product.

58. The container of claim 57, wherein the substantially upright sidewall assembly comprises four wall panels forming a generally rectangular tub.

59. The container of claim 58, wherein the base comprises legs at corners defined by the intersections of adjacent wall panels, the legs separated by notches formed by removal of portions of the wall panels.

60. The container of claim 58, wherein the substantially upright sidewall assembly comprises a unitary paperboard blank folded to form the four wall panels.

61. The container of claim 58, wherein the base comprises a substantially continuous base panel extending between two opposed wall panels.

62. The container of claim 61, formed from a first paperboard blank and a second paperboard blank, wherein the first paperboard blank is folded to form two opposed wall panels and the base panel, and the second paperboard blank is folded to form two opposed wall panels and a floor panel therebetween.

63. The container of claim 57, comprising a generally cylindrical tub having one wall panel closed upon itself.

64. The container of claim 57, wherein the floor comprises a microwave susceptor material.

65. The container of claim 64, wherein the microwave susceptor material comprises a sized metal layer, the microwave susceptor material disposed to the interior face of the floor.

66. The container of claim 64, wherein the microwave susceptor material comprises a sized metal layer, the microwave susceptor material disposed to the exterior face of the floor.

67. The container of claim 57, wherein the floor is moisture-impervious.

68. The container of claim 57, wherein the floor comprises a polymer and paperboard laminate.

69. The container of claim 57, wherein the sheet of barrier material comprises a polyester film.

70. The container of claim 57, wherein the sheet of barrier material is continuously sealed to the interior face of the at least one wall panel by heat sealing.

71. The container of claim 57, wherein the at least one wall panel slopes outwardly from the base to the mouth, whereby multiple containers can be nestably stacked.

72. The container of claim 57, comprising a first attachment between the sidewall assembly and the barrier material.

73. The container of claim 72, wherein the first attachment is approximately mid-height along each the at least one wall panel.

74. The container of claim 73, further comprising a second attachment between the sidewall assembly and the barrier material adjacent the mouth of the container.

75. A container for microwave heating of a food product, the container comprising:

(a) a substantially upright sidewall assembly comprising a base, a mouth, and at least one wall panel extending between the base and the mouth;

(b) a floor extending substantially horizontally from the at least one wall panel adjacent the base, the floor having an interior face and an exterior face and the at least one wall panel having an interior face and an exterior face;

(c) a sheet of barrier material, the interior face of the at least one wall panel and the interior face of the floor forming a volume for containing the food product, the sheet of barrier material being sealed to the interior face of the at least one wall panel; and (d) at least one projection formed on the at least one wall panel, the projection being movable between an inoperative position where the projection is co-planar with the wall panel and the operative position where the projection extends outwardly from the wall panel.

76. The container of claim 75, wherein the at least one projection comprises a flap portion, the flap portion being movable about a substantially non-vertical axis.

77. A container for microwave heating of a food product, the container comprising:

(a) a substantially upright sidewall assembly comprising a base, a mouth, and at least one wall panel extending between the base and the mouth;

(b) a floor extending substantially horizontally from the at least one wall panel adjacent the base, the floor having an interior face and an exterior face and the at least one wall panel having an interior face and an exterior face; and (c) a sheet of barrier material, the interior face of the at least one wall panel and the interior face of the floor forming a volume for containing the food product, the sheet of barrier material being sealed to the interior face of the at least one wall panel; and (d) a handle formed on the at least one wall panel, the handle being movable between an inoperative position where the handle is co-planar with the wall panel and the operative position where the handle extends away from the wall panel.

78. The container of claim 77, wherein the handle is movable about a substantially non-horizontal axis.

* * * * *